US009596937B2

(12) United States Patent
Ng

(10) Patent No.: US 9,596,937 B2
(45) Date of Patent: Mar. 21, 2017

(54) SEAT CORE

(71) Applicant: Boon Long Ng, Singapore (SG)

(72) Inventor: Boon Long Ng, Singapore (SG)

( * ) Notice: Subject to any disclaimer, the term of this patent is extended or adjusted under 35 U.S.C. 154(b) by 0 days.

(21) Appl. No.: 14/120,713

(22) Filed: Jun. 19, 2014

(65) Prior Publication Data

US 2014/0375102 A1 Dec. 25, 2014

(30) Foreign Application Priority Data

Jun. 21, 2013 (GB) ..... 1311073.9

(51) Int. Cl.
*A47C 7/00* (2006.01)
*A47C 4/02* (2006.01)
*A47C 3/00* (2006.01)

(52) U.S. Cl.
CPC ..... *A47C 4/024* (2013.01); *A47C 3/00* (2013.01)

(58) Field of Classification Search
CPC .... A47C 4/02; A47C 4/03; A47C 7/42; A47C 7/546
USPC ... 297/440.1, 446.2, 440.14, 440.15, 440.16, 297/440.22, 440.23, 344.18; 108/147.19, 108/147.21; 403/109.3, 109.6
See application file for complete search history.

(56) References Cited

U.S. PATENT DOCUMENTS

| | | | | | |
|---|---|---|---|---|---|
| 1,644,336 | A * | 10/1927 | Gunlocke | A47C 3/00 | 248/188 |
| 1,711,959 | A | 5/1929 | Morin | | |
| 2,272,948 | A * | 2/1942 | Johnson | A47C 7/26 | 16/42 T |
| 3,455,605 | A * | 7/1969 | Anderson | 297/446.2 | |
| 3,556,594 | A * | 1/1971 | Anderson | 297/452.59 | |
| 3,687,092 | A * | 8/1972 | Manning | 108/156 | |
| 3,957,239 | A * | 5/1976 | Slaats et al. | 248/188 | |
| 3,971,587 | A * | 7/1976 | Curtis et al. | 297/452.52 | |
| 4,066,295 | A * | 1/1978 | Severson | 297/440.16 | |
| 6,776,380 | B1 * | 8/2004 | Kirk et al. | 248/188 | |
| 2003/0160494 | A1 * | 8/2003 | Coffield | 297/440.11 | |
| 2013/0099541 | A1 * | 4/2013 | Hung | 297/344.21 | |

FOREIGN PATENT DOCUMENTS

DE 299 08 184 U 7/1999

* cited by examiner

*Primary Examiner* — Beth Stephan

(57) ABSTRACT

A seat core comprising a unitary body (1) including a peripheral wall (4, 5, 7) provided with a plurality of recesses (2), each recess being provided with at least one aperture (8) adapted to receive securing means for securing a chair component within the recess.

18 Claims, 7 Drawing Sheets

SEAT CORE

FIELD OF THE INVENTION

This invention relates to a seat core and more particularly, but not exclusively, to a seat core for use in knock-down chairs.

A seat core is that part of a piece of furniture which supports a user and around which the remainder of the piece of furniture is assembled. For example, in the case of a dining chair, the seat core is effectively the seating part of the chair to which front legs of the chair are secured and which is also secured to a back frame assembly which provides the legs and back of the chair.

BACKGROUND TO THE INVENTION

Chairs, such as dining chairs, are typically available in two versions. That is, a dining chair is either provided pre-assembled or is provided in parts to be assembled by a user. Such a chair which is provided in parts is commonly referred to as a 'knock-down' chair.

Knock-down chairs have an advantage in that they take less space when being transported because they can be flat packed. This has the desirable consequence of reducing transportation costs.

However, the wooden frames conventionally used for knock-down chairs can have weaknesses due to faults, such as knots, in the wood and such weaknesses may not always be visible during assembly or manufacture. Such faults may lead to undesirable variations in the strength of the frame. Moreover, slight skews, for example due to imperfections in the wood or errors in assembly of standardisation of the manufacture of pre-assembly parts, can lead to the resulting chair having a wobble, which is undesirable and can lead to a chair being returned for replacement.

Softwoods, although significantly less expensive than hardwoods, are particularly prone to drying and age imperfections. Moreover, the use of hardwoods in furniture is tightly regulated to ensure the source of the wood can be traced. Thus the use of hardwood can further increase the cost of a chair having a wooden frame because the wood may only be obtained from certain suppliers.

OBJECT OF THE INVENTION

It is therefore an object of the present invention to provide a seat core which overcomes, or at least ameliorates, the above disadvantages.

SUMMARY OF THE INVENTION

According to the present invention there is provided a seat core comprising a unitary body including a peripheral wall provided with a plurality of recesses, each recess being provided with at least one aperture adapted to receive securing means for securing a chair component within the recess.

The peripheral wall of the unitary body may include substantially parallel front and rear walls interconnected by side walls. The unitary body may be substantially trapezoidal in configuration.

Alternatively, the peripheral wall of the unitary body may include a front wall which is curved, for example arcuate.

The peripheral wall of the unitary body may include two recesses. The recesses may be located in opposing end regions of a front wall of the peripheral wall.

The recesses may be open at least at one end thereof. For example, the recesses may be open at opposing ends thereof.

The recesses may be of substantially square tubular form.

The apertures may be provided in a wall portion of each recess. The wall portion may be at substantially 45 degrees to adjoining side walls of the recess.

Internal walls of the recesses may be provided with formations to inhibit removal of a chair component therefrom.

At least portions of the peripheral wall may have an internal lattice or honeycomb structure.

The unitary body may be manufactured by injection moulding. The unitary body may be made of a plastics material, for example polypropylene.

The peripheral wall may include a rear wall, the rear wall being provided with at least one aperture to permit the connection of at least one further chair component to the unitary body. An aperture may be provided substantially mid-way along the rear wall and further apertures are positioned each side of the first-mentioned aperture.

The seat core may include reinforcing means positioned in a region defined by the peripheral wall. The reinforcing means may comprise a substantially planar member forming a top surface of the seat core when in use. The substantially planar member may be resiliently deformable. The planar member may be provided with an array of perforations. Alternatively, the reinforcing means may include a supporting lattice. As a further alternative, the reinforcing means may be of a skeleton construction, for example in the form of a lattice. According to another alternative, the reinforcing means may be in the form of slats. According to a further alternative, the reinforcing means may extends around lower edges of the unitary body in use of the seat core, the reinforcing means comprising, for example, a rib extending into the region defined by the peripheral wall. In such a case, the reinforcing means may include substantially triangular portions arranged at least at some corner regions of the reinforcing means.

The peripheral wall may be provided on the outside thereof with a plurality of indentations which extend to an upper edge of the peripheral wall.

The present invention also relates to a kit for a knock-down chair including a seat core as hereinbefore defined and a plurality of chair legs. The kit may also include a chair back.

For a better understanding of the present invention and to show more clearly how it may be carried into effect reference will now be made, by way of example, to the accompanying drawings in which:

DESCRIPTION OF PREFERRED EMBODIMENTS

Figure 1:
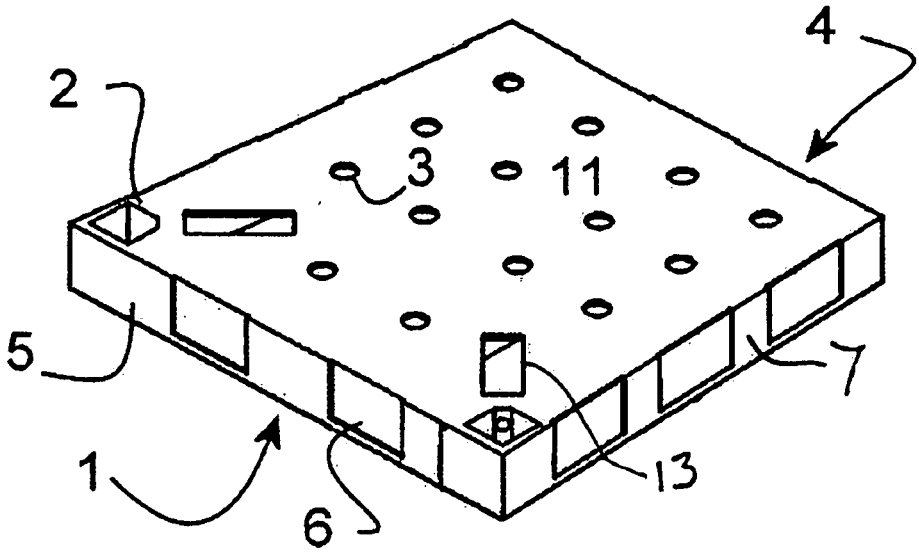
FIG. 1 is an isometric view from above of one embodiment of a seat core according to the present invention.
Figure 2:
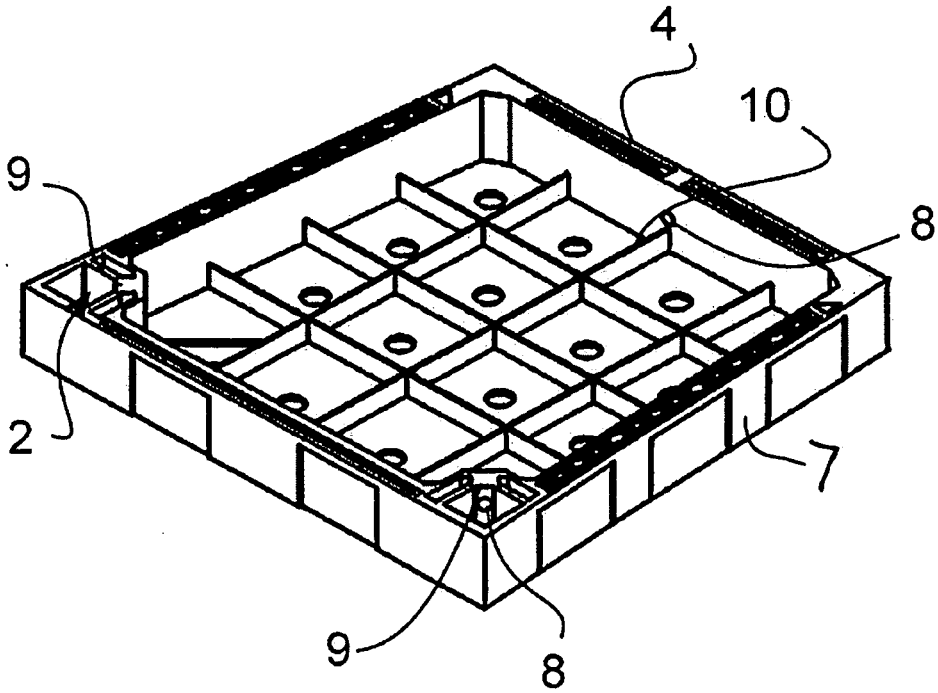
FIG. 2 is an isometric view from below of the seat core shown in FIG. 1.
Figure 3:
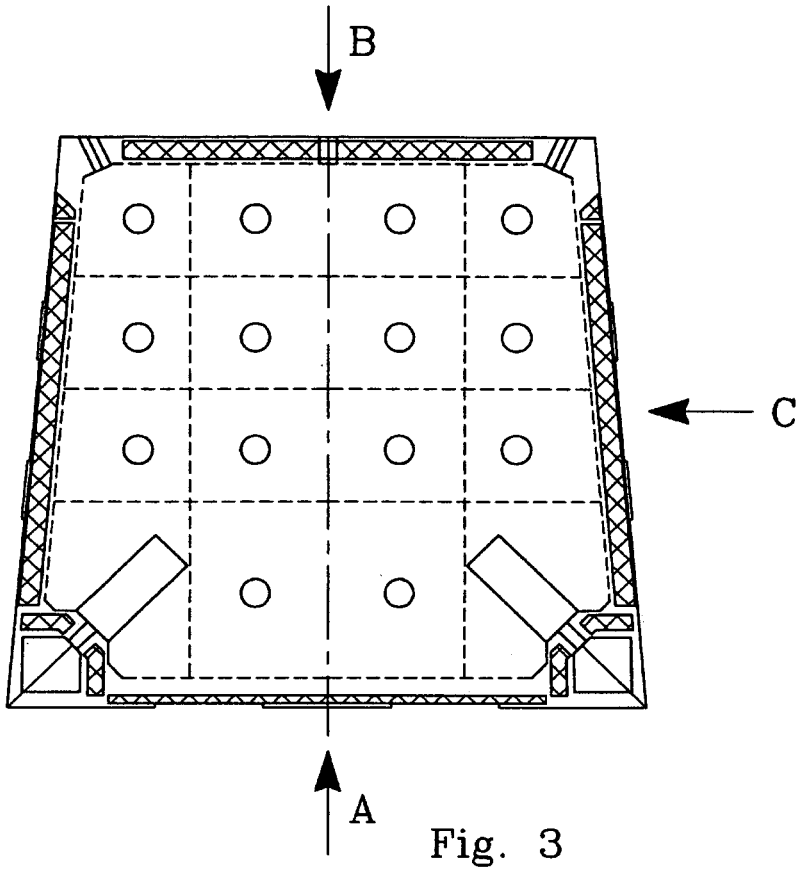
FIG. 3 is a plan view from above of the seat core shown in FIG. 1.
Figure 4:
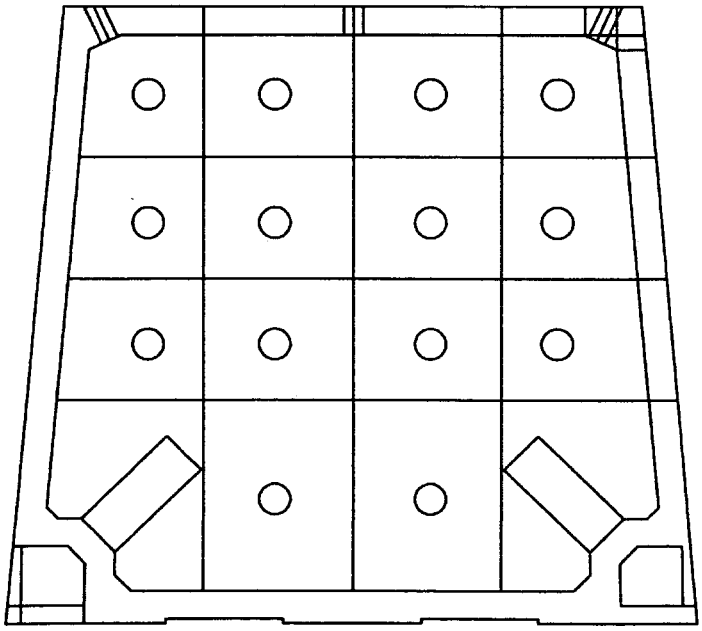
FIG. 4 is a plan view from below of the seat core shown in FIG. 1.
Figure 5:
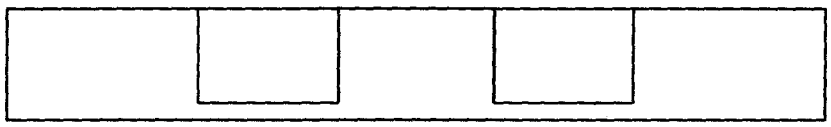
FIG. 5 is a side view of the seat core shown in FIG. 1 in the direction of the arrow A of FIG. 3.
Figure 6:
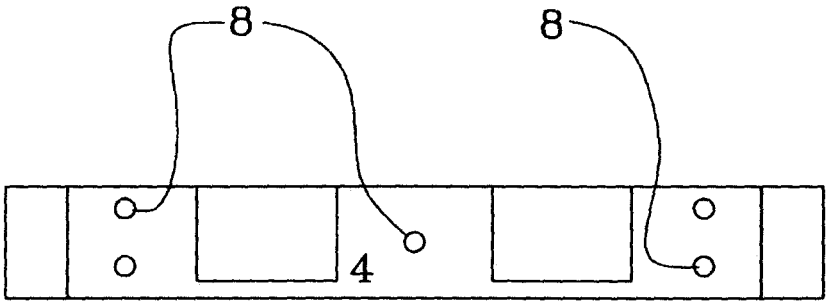
FIG. 6 is a side view of the seat core shown in FIG. 1 in the direction of the arrow B in FIG. 3.
Figure 7:
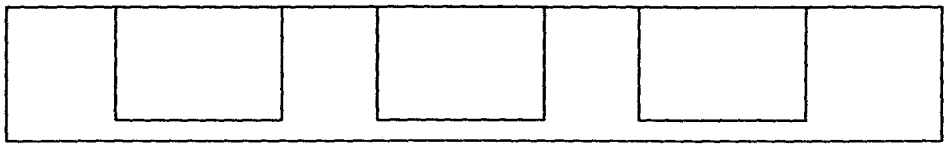
FIG. 7 is a side view taken of the seat core shown in FIG. 1 in the direction of the arrow C shown in FIG. 3.
Figure 8:
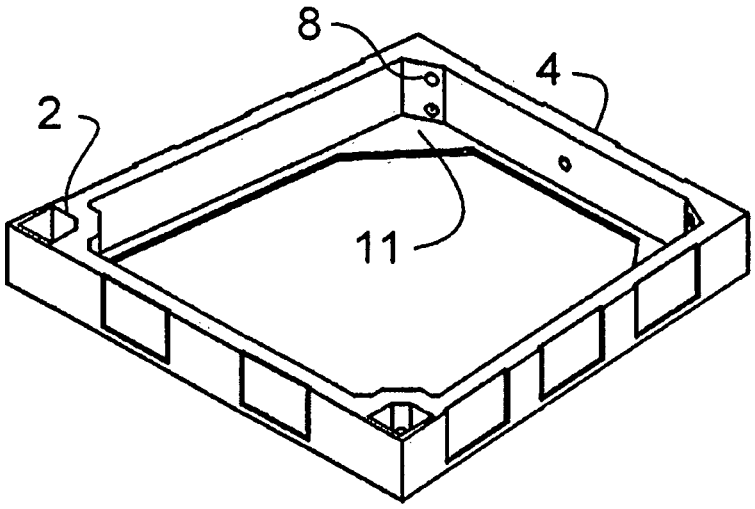
FIG. 8 is an isometric view from above of a second embodiment of a seat core according to the present invention.
Figure 9:
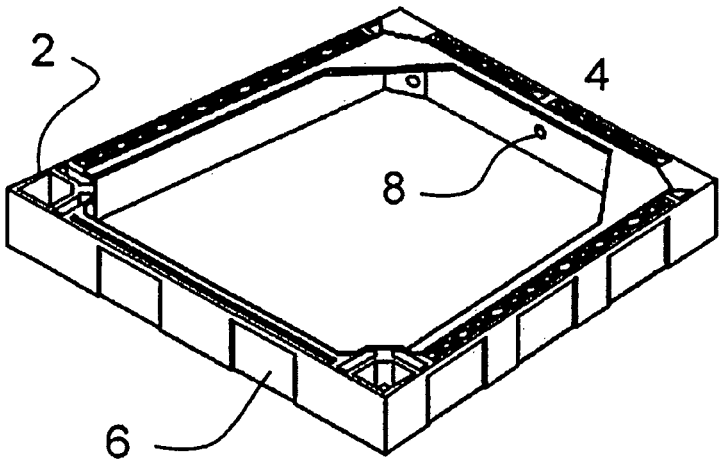
FIG. 9 is an isometric view from below of the seat core shown in FIG. 8.
Figure 10:
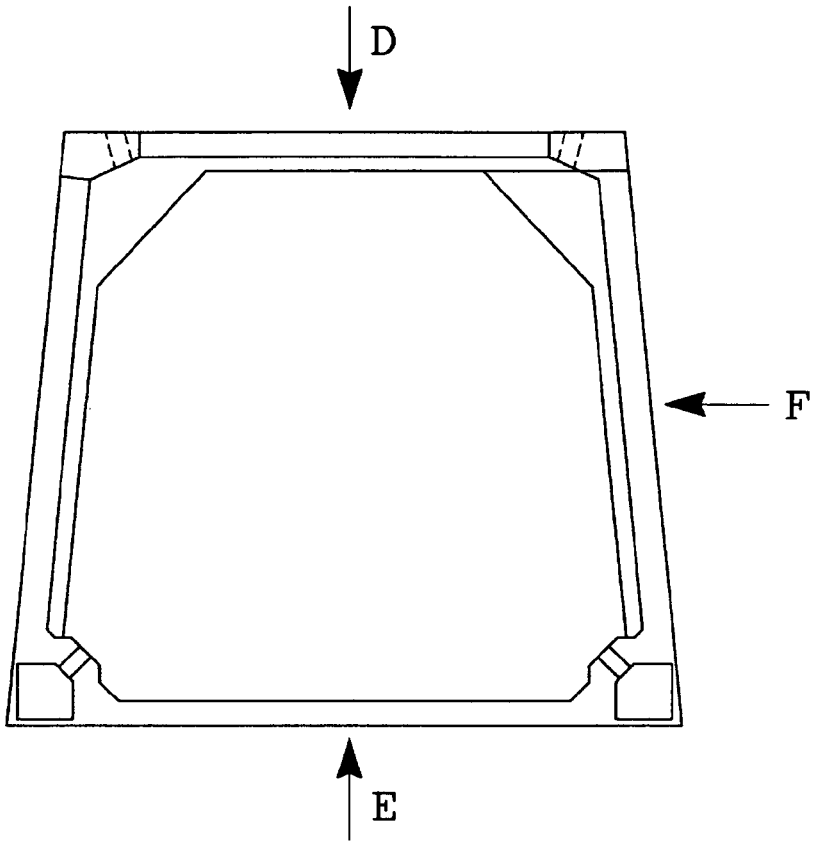
FIG. 10 is a plan view from above of the seat core shown in FIG. 8.
Figure 11:
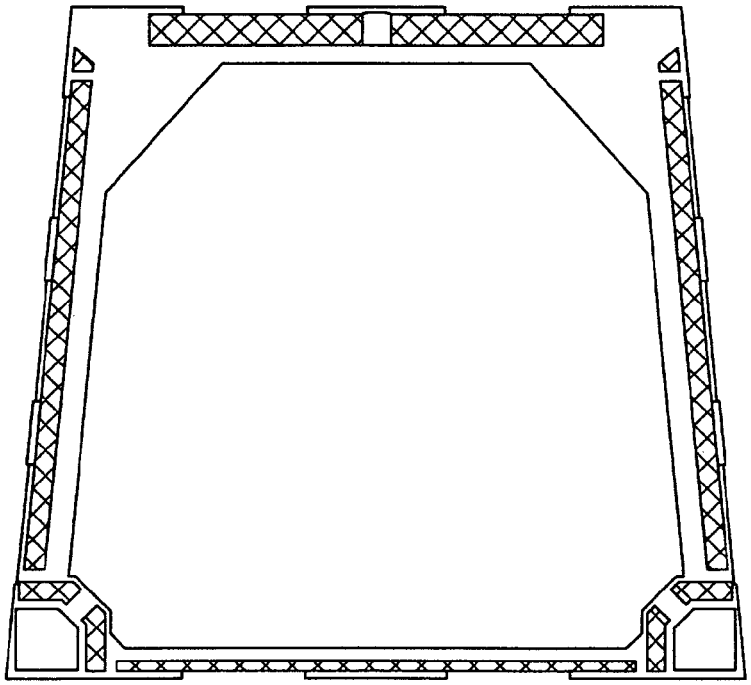
FIG. 11 is a plan view from below of the seat core shown in FIG. 8.
Figure 12:
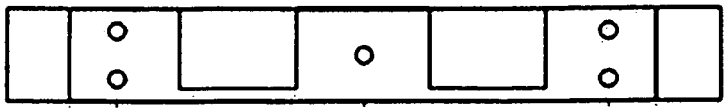
FIG. 12 is a side view of the seat core shown in FIG. 8 in the direction of the arrow D in FIG. 10.
Figure 13:
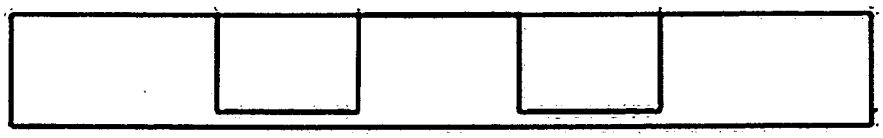
FIG. 13 is a side view of the seat core shown in FIG. 8 in the direction of the arrow E in FIG. 10.
Figure 14:
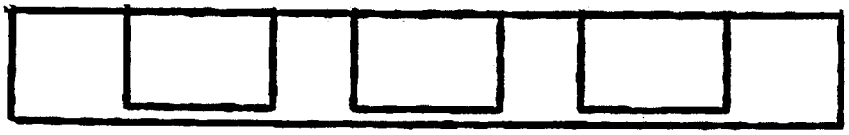
FIG. 14 is a side view of the seat core shown in FIG. 8 in the direction of the arrow F in FIG. 10.

The seat core shown in FIGS. 1 to 7 comprises a generally trapezoidal unitary body 1 which is formed integrally, for example from a plastics material such as the thermoplastics material polypropylene, for example by casting (for example, by injection moulding) or printing. Injection moulding in particular has the advantage of providing uniform strength throughout the seat core, unlike a wooden seat frame that is liable to include weak points, for example where the wood includes one or more knots. Injection moulding therefore permits the convenient manufacture of a large number of uniform products, each in a single stage, in a short time compared with the manufacture of wooden chairs. No assembly is required to manufacture the seat core, although more than one core may be formed simultaneously, the cores being separated at a convenient opportunity, such as when the cores are formed or when chairs are formed from the seat cores. The use of plastics materials in place of wood also has the advantage of reducing regulatory requirements and their associated costs, for example because there is no need to prove the source of hardwoods and the need to satisfy traceability regulations.

The unitary body includes substantially parallel front and rear walls 5 and 4 respectively interconnected by side walls 7. The walls may have a thickness of about 20 mm. A longer front wall 5 compared with the rear wall 4 provides a greater width to accommodate a user's legs. Portions of the walls of the unitary body 1 may have an internal lattice or honeycomb structure to provide strength while reducing the weight of the unitary body and also the amount of material required. For example, a diagonally arranged lattice may define multiple triangular sections within part of the body 1 that serve as reinforcement. Ideally the walls 5, 4 and 7 have a continuous inner and outer surface with a lattice structure between the two surfaces. Alternatively, though, at least part of the walls may be formed with a lattice structure. Although the front wall is shown as being linear, the wall could alternatively be curved, for example arcuate. As a further alternative, the body 1 need not be trapezoidal, but may be, for example, square, rectangular, triangular or circular.

The unitary body 1 is formed with two recesses 2, one in the region of each of the corners located at the ends of the longer parallel front wall 5 of the trapezium, for receiving a component of a chair, such as a chair leg. As illustrated, the recesses are positioned at the front corners of the seat core when in use and open at the lower face of the body 1 and optionally also at the top face of the body. However, if desired the recesses 2 may be offset from the corners of the body 1. The recesses 2 are of generally square tubular form, for example having a wall length of about 40 mm, so as to extend around an end of the chair component, in particular a front leg member of a chair. Apertures 8 open into a wall portion 9 of each of the recesses 2 for receiving securing means, such as a screw 12, a bolt or a nail, for securing the chair component in each of the recesses 2. The wall portion 9 of each recess 2 is positioned across that corner of the generally square tubular form which does not form part of either the front wall 5 or a side wall 7 of the unitary body 1, the wall portion 9 extending approximately at 45 degrees to adjoining side walls forming the generally square tubular form. The wall portion 9 is ideally of solid material (i.e., not internally latticed or of honeycomb form) to provide a robust positioning for the screw 12, however the wall portion 9 may be of internally latticed or honeycomb form if desired, especially where the resulting chair is only intended for lightweight users, such as children. Other walls of the recesses 2, particularly the walls of the recesses incorporated into regions the front and side walls of the unitary body, may also be of solid material, but may alternatively be of internally latticed or honeycomb form.

The internal walls of the recesses 2 may be provided with formations, such as nubs, raised and lowered portions or teeth, to allow insertion of the chair component into the recess, but to inhibit removal of the chair component therefrom.

Apertures 8 are also provided in the rear wall 4 to allow the body 1 to be connected to further chair components, in particular a backrest and/or rear legs of a chair. For example, an aperture may be positioned substantially midway along the rear wall substantially midway between the top and the bottom of the wall and further apertures may be positioned each side of the first aperture, for example spaced about 160 mm from the first aperture. The further apertures 8 may be arranged in pairs, one above the other.

Rigidity of the unitary body 1 is increased by reinforcing means 11 which in the embodiment of FIGS. 1 to 7 comprises a planar member 11 extending between upper edges, in use, of the front, rear and side walls 5, 4 and 7, respectively, and formed integrally with the remainder of the unitary body so as to provide a top surface when the seat core is in use. The top surface provides a platform upon which a user may be directly or indirectly seated. The top surface may have dimensions of at least 350 mm by 400 mm so as to be suitable for use in standard dining room chairs. Ideally the front wall 5 may have a length of 450 mm, while the rear wall 4 is somewhat shorter at 380 mm and the side walls 7 may have a length of 425 mm. The front wall 5 generally requires to be up to 100 mm longer than the rear wall 4 for accommodating the user's legs. The walls may extend substantially perpendicular to the planar member 11 and around the periphery thereof. The planar member 11 may provide a resiliently deformable member on which a user may sit, the planar member deforming under the weight of the user and returning to its original form when the user is no longer sitting.

The front, rear and side walls are preferably at least about 60 mm deep, for example 63 mm deep, therefore being shallow relative to the dimensions of the reinforcing means 11, but sufficiently deep to provide purchase for upholstering. The front, rear and side walls are preferably at least 10 mm thick, more preferably at least 15 mm thick. The thickness of the walls may depend on the type of chair and the weight it is designed to bear. For example, a child's chair may have thinner walls than an adult's chair.

Typically, the reinforcing means 11 is 3 mm thick and may include perforations 3 to allow for ventilation and deformation. The surface of the reinforcing means may be indented if desired. Alternatively, the reinforcing means may be in the form of a lattice or slats. In the illustrated embodiment, the reinforcing means is provided with an array of substantially circular apertures 3, for example having a diameter of about 20 mm and a substantially rectangular aperture 13 extending in the elongate direction thereof diagonally from each of the recesses 2 towards the central region of the reinforcing means. The rectangular aperture 13 in use of an upholstered chair incorporating the seat core facilitates the release of air from the upholstered seat and subsequent re-inflation thereof. The aperture also facilitates assembly of a chair incorporating the seat core by enabling more ready access for driving means, such as an Allen key, for securing fasteners 12. Each rectangular aperture may have a length of about 80 mm and a width of about 30 mm. If desired, a supporting lattice 10 in the form of an intersecting rectilinear grid of ribs may be formed on the lower side, in use, of the reinforcing means to provide a lightweight skeleton construction in the form of a lattice of strengthening braces of minimal weight but providing structural rigidity in a plurality of planes or directions. Without apertures allowing the passage of air the seat would be very uncomfortable when first sat on and would be left with a depression after use and which would take time to recover. Neither of these aspects is desirable, either from a practical or an aesthetic point of view.

The body 1 is generally covered, for example upholstered, when incorporated into a chair, as may be the remainder of the chair. The perforations 3 in the reinforcing means 11 may be used for the securement of upholstery. Additionally or alternatively, the walls 4, 5 and 7 may be provided with cutaway portions (not shown) to provide purchase for materials used when covering the body 1, such as fabric and/or padding.

A plurality of indentations 6 are optionally provided in the front, rear and side walls 5, 4 and 7 which extend to an upper edge of the side walls to further facilitate the escape of and refilling of air from a seat cushion (not shown) when the seat is sat on or stood up from. The indentations 6 may have a width of about 76 mm along the front and rear walls with adjacent indentations being spaced about 87 mm apart. This allows for two indentations on each of the front and rear walls evenly spaced from the mid-point of the respective wall. The height of the indentations may be about 54 mm, leaving a height of about 9 mm of the respective wall with no indentation. The depth of the indentations into the respective wall may be about 3 mm. The indentations may have a width of about 80 mm along the side walls with adjacent indentations being spaced about 41 mm apart. This allows for three indentations on each side wall evenly arranged about the mid-point of the respective wall.

The seat core shown in FIGS. 8 to 14 is similar to that shown in FIGS. 1 to 7, but differs in respect of the reinforcing means 11. In this embodiment the reinforcing means 11 extends around the lower edges, in use, of the rear and side walls 4 and 7, respectively, and which may optionally additionally extend along the front wall 5, in each case internally and extending laterally inwardly of the body 1. The reinforcing means 11 may be in the form of a rib generally having a width of about 12 mm, with a triangular region in the corners between the side and rear walls (further triangular regions may additionally be provided in the corners between the front and side walls if desired). The triangular regions may have a side length of about 79 mm along the side wall 7 and a hypotenuse of about 104 mm. Thus the body 1 provides a central cavity or depression where seating materials, such as padding with a flexible cover or a covered spring arrangement, can be added or arranged if required to provide a comfortable seat for a use. As an alternative, the reinforcing means may be provided at any location along the upright extent, in use, of the walls of the body 1. As a further alternative, the reinforcing means may simply be in the form of a lattice extending, in use, at least part of the upright extent of the walls of the body and positioned at any convenient location along the upright extent of the walls of the body.

Ideally, the front wall 5 may have a length of 425 mm, while the rear wall is somewhat shorter at 350 mm and the side walls may have a length of 405 mm. The front, rear and side walls may be about 58 mm deep and may have a thickness of about 18 mm. The optional indentations 6 may have a width of about 70 mm along the front and rear walls with adjacent indentations being spaced about 80 mm apart resulting in two indentations in each of the front and rear walls evenly spaced from the mid-point of the respective wall. The height of the indentations may be about 50 mm, leaving a height of about 8 mm of the respective wall with no indentation. The depth of the indentations may be about 3 mm. The indentations may have a width of about 72 mm along the side walls with adjacent indentations being spaced about 40 mm apart. This allows for three indentations on each side wall evenly arranged about the mid-point of the respective wall.

Clearly the seat core according to the present invention may be modified in a number of ways. For example, there may be variations in size, materials, shape, form, function and manner of operation, assembly and use.

Figure 15:
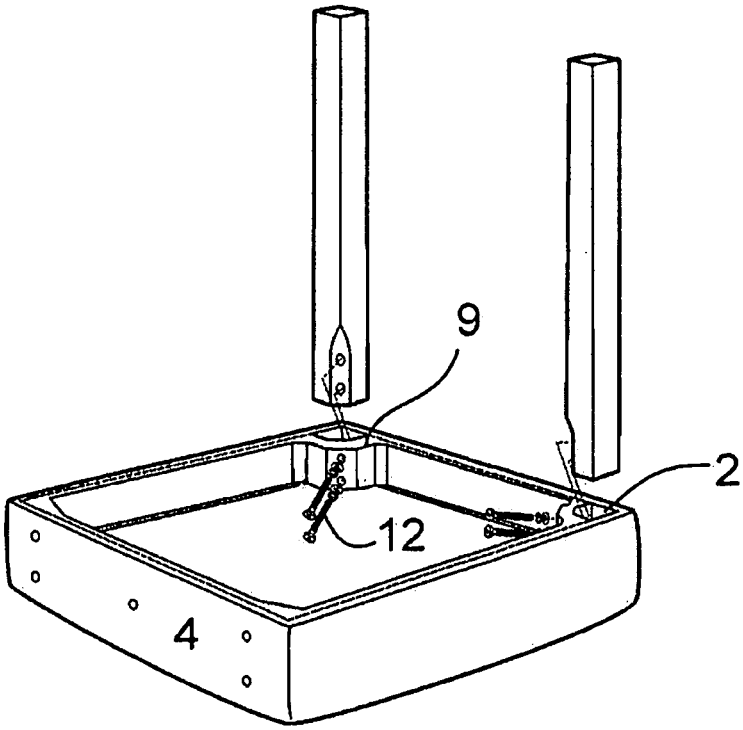
FIGS. 15 and 16 show an embodiment of a seat core according to the present invention in use as part of a chair.
Figure 16:
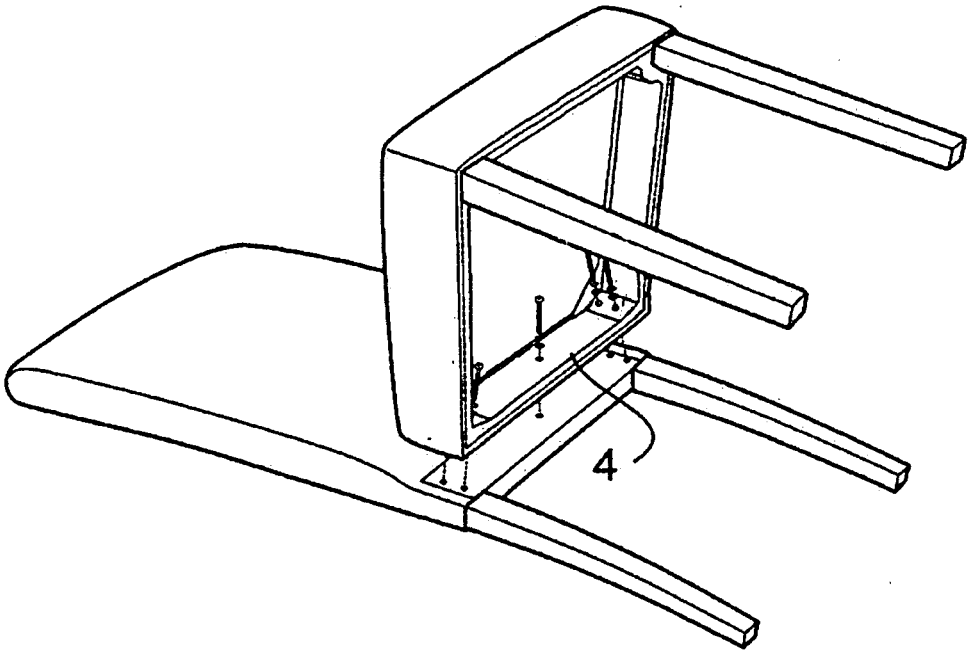

FIGS. 15 and 16 show an embodiment of a seat core in use as part of a chair, including front chair legs and a chair back. The front chair legs and the chair back may conveniently be made of or incorporate (soft) wood, in particular for the chair legs. Typically, the seat core is used as part of a kit in the form of a knock-down chair, in particular a dining room chair comprising the seat core, four chair legs and a backrest. The chair can be provided flat packed and can then subsequently be assembled. In particular, the seat core is lightweight and can readily be stacked. In this way, the chair can be transported and stored more easily than a conventional chair because it takes up less space, with the result that the chair may be available to a user at less cost than a corresponding conventional chair made of wood.

The front chair legs are inserted into the recesses and secured in place with securing means, such as screws which pass through the apertures 8 and into the chair leg.

The chair back is in the form of a frame with a backrest and rear legs and is attached to the seat core substantially at a mid-point of the chair back, between the backrest and the rear legs. Alternatively, the chair back may comprise substantially only at least one rear leg (not shown). In FIG. 16 the backrest is shown as being upholstered, but this is not essential. As illustrated, the chair back is secured to the seat core by securing means, such as screws which pass through the apertures 8 in the body 1 and into the chair back.

In this way the front chair legs and the chair back are secured to the seat core to form a multi-legged chair, stool or other piece of elevated surface furniture depending on the configuration of the front chair legs and the chair back.

I claim:

1. A seat core comprising a unitary body including a peripheral wall comprised of front, rear, and opposite side portions, having an upper edge and lower edge, and being provided with a plurality of recesses, each recess being provided with at least one aperture adapted to receive securing means for securing a chair component within the recess, and reinforcing means positioned in a region defined by the peripheral wall and extending laterally inwardly from the lower edge of the peripheral wall so the reinforcing means extends further inwardly than the upper edge, the reinforcing means comprising a rib in the form of a flange extending at least along the side and rear portions of the lower edge of the peripheral wall with substantially triangular rib portions arranged at least at corner regions located between the side and rear portions of the peripheral wall, the rib extending laterally inwardly from an internal side of the peripheral wall in a direction toward a center of the unitary body.

2. The seat core of claim 1, wherein the unitary body is substantially trapezoidal in configuration.

3. The seat core of claim 1, wherein the plurality of recesses in the peripheral wall of the unitary body consists of two recesses.

4. The seat core of claim 3, wherein one of the two recesses is located in each of the opposing end regions of a front wall portion of the peripheral wall.

5. The seat core of claim 1, wherein the plurality of recesses are open at least at one end thereof.

6. The seat core of claim 5, wherein the plurality of recesses are open at opposite ends thereof.

7. The seat core of claim 1, wherein the plurality of recesses are of substantially square tubular form.

8. The seat core of claim 7, wherein the at least one aperture is provided in a wall portion defining each of the plurality of recesses.

9. The seat core of claim 8, wherein the recess-defining wall portion is at substantially 45 degrees to adjoining side walls of the each of the plurality of recesses.

10. The seat core of claim 1, wherein at least portions of the peripheral wall are selected from an internal lattice and a honey-comb structure.

11. The seat core of claim 1, wherein the unitary body is manufactured by injection moulding.

12. The seat core of claim 1, wherein the rear portion of the peripheral wall is provided with at least one aperture to permit the connection of at least one further chair component to the unitary body.

13. The seat core of claim 12, wherein the at least one aperture is provided substantially mid-way along the rear portion of the peripheral wall, and wherein further apertures are positioned along the rear portion of the peripheral wall to each side of the at least one aperture.

14. The seat core of claim 1, wherein the peripheral wall is provided on an outside thereof with a plurality of indentations which extend to the upper edge of the peripheral wall.

15. A kit for a knock-down chair including a seat core as claimed in claim 1 and a plurality of chair legs.

16. The kit of claim 15 further comprising a chair back.

17. A seat core comprising a unitary body including a peripheral wall having front, rear, and opposite side walls, having an upper edge and a lower edge, and being provided with a plurality of recesses, each recess being provided with at least one aperture adapted to receive a securing member, the securing member securing a chair component within the recess, and a reinforcing rib positioned in a region internal of the peripheral wall and extending laterally inwardly of the lower edge of the peripheral wall so that the reinforcing rib extends further inwardly than the upper edge, the rib extending at least along the side and rear walls of the lower edge of the peripheral wall with substantially triangular rib portions arranged at least at a corner region to extend from the side wall to the rear wall.

18. A seat core comprising a unitary body including a peripheral wall having front, rear, and opposite side portions, having an upper wall and a lower edge, and being provided with a plurality of recesses, each recess being provided with at least one aperture adapted to receive a securing member, the securing member securing a chair component within the recess, and a reinforcing rib positioned in a region internal of the peripheral wall and extending laterally inwardly of the lower edge so the reinforcing rib extends further inwardly than the upper edge, the reinforcing rib extending the lower edge of the peripheral wall with substantially triangular rib portions arranged at least at a corner region, the substantially triangular rib portions lying in a plane spaced from and parallel to a plane of the upper wall.

* * * * *